US008046847B1

(12) United States Patent
Doyle

(10) Patent No.: US 8,046,847 B1
(45) **Date of Patent: *Nov. 1, 2011**

(54) UNIVERSAL SHOULDER PROTECTOR

(76) Inventor: Thomas H. Doyle, Midlothian, VA (US)

( * ) Notice: Subject to any disclaimer, the term of this patent is extended or adjusted under 35 U.S.C. 154(b) by 489 days.

This patent is subject to a terminal disclaimer.

(21) Appl. No.: 12/315,516

(22) Filed: Dec. 4, 2008

Related U.S. Application Data

(63) Continuation-in-part of application No. 11/070,939, filed on Mar. 3, 2005, now Pat. No. 7,461,409.

(51) Int. Cl.
*A41D 13/00* (2006.01)

(52) U.S. Cl. ..... 2/459

(58) Field of Classification Search ..... 2/459, 268, 2/455, 44, 45, 468, 467, 908; 128/878, 876; 602/4, 5, 18, 20, 62; 224/257, 264, 265, 224/600, 901

See application file for complete search history.

(56) References Cited

U.S. PATENT DOCUMENTS

| | | | | | |
|---|---|---|---|---|---|
| 689,837 | A * | 12/1901 | Whitney | 2/461 |
| 2,487,423 | A * | 11/1949 | Cast | 224/264 |
| 2,763,870 | A * | 9/1956 | Mitchell | 2/255 |
| 2,802,216 | A * | 8/1957 | Vogel | 2/268 |
| 4,675,912 | A * | 6/1987 | Kirkland | 2/462 |
| 5,068,924 | A * | 12/1991 | Ross | 2/268 |
| 6,295,655 | B1 * | 10/2001 | Johe | 2/461 |
| 7,461,409 | B1 * | 12/2008 | Doyle | 2/459 |

* cited by examiner

*Primary Examiner* — Tejash Patel

(57) ABSTRACT

A shoulder protector comprising a generally "U" shaped device of a resilient material that fits over the shoulder comprising: a base; and a pair of flanges extending orthogonally from the base that define a channel for reception of the scapula area of the body. According to various preferred embodiments, the shoulder protector of the present invention includes; 1) a hygienic layer on the side of the device that addresses the body; 2) an adherent layer that engages an overworn jersey on that surface of the device that lies away from the body of the user; enlarged shoulder pad areas that extend over and below the shoulder of a user; and removable rigid or semi-rigid shoulder pads that can be removably attached to the shoulder protector of the present invention.

14 Claims, 7 Drawing Sheets

UNIVERSAL SHOULDER PROTECTOR

This application is a Continuation-In-Part of U.S. patent application Ser. No. 11/070,939 filed Mar. 3, 2005 now U.S. Pat. No. 7,461,409 and copending herewith.

FIELD OF THE INVENTION

The present invention relates to a shoulder protection device for participants in such sports as bicycling and motorcycling.

BACKGROUND OF THE INVENTION

Participants in such sports as bicycling, motorcycling, roller blading, running, ice skating, horse back riding etc. are relatively prone to falling under certain adverse conditions. The normal reaction in such a falling conditions is to extend the hand or arm to break the fall. Such action almost inevitably results in breakage of the extended appendage as it strikes the ground. More experienced participants in such activities have learned to "tuck", i.e. retract the hand and arm, and to rely upon the shoulder to absorb the shock of the body striking the ground. While such a "tucking" action reduces the possibility of damage to the hand and arm, it exposes the shoulder and shoulder area including the scapula to damage in the form of dislocation of the shoulder joint or breakage of the scapula. Thus, the availability of a device that would protect the shoulder and scapula under such falling conditions would be highly valuable.

OBJECT OF THE INVENTION

It is therefore an object of the present invention to provide a shoulder protector for use by participants in the active sports recited above and other similar activities where falling is possible, which shoulder protector eliminates, reduces or minimizes the damage to the shoulder area in such a falling situation.

SUMMARY OF THE INVENTION

According to the present invention there is provided a shoulder protector comprising a generally "U" shaped device of a resilient material that fits over the shoulder comprising: a base; and a pair of flanges extending orthogonally from the base that define a channel for reception of the scapula area of the body. According to various preferred embodiments, the shoulder protector of the present invention includes; 1) a hygienic layer under the side of the device that addresses the body; and 2) an adherent layer that engages any overworn clothing or jersey on that surface of the device that lies away from the body of the user. The incorporation of the shoulder protector into a jersey or any clothing is also described as is the incorporation of a removable shoulder pad to provide added protection for the shoulder in such higher speed activities as motorcycling.

DETAILED DESCRIPTION

Figure 1:
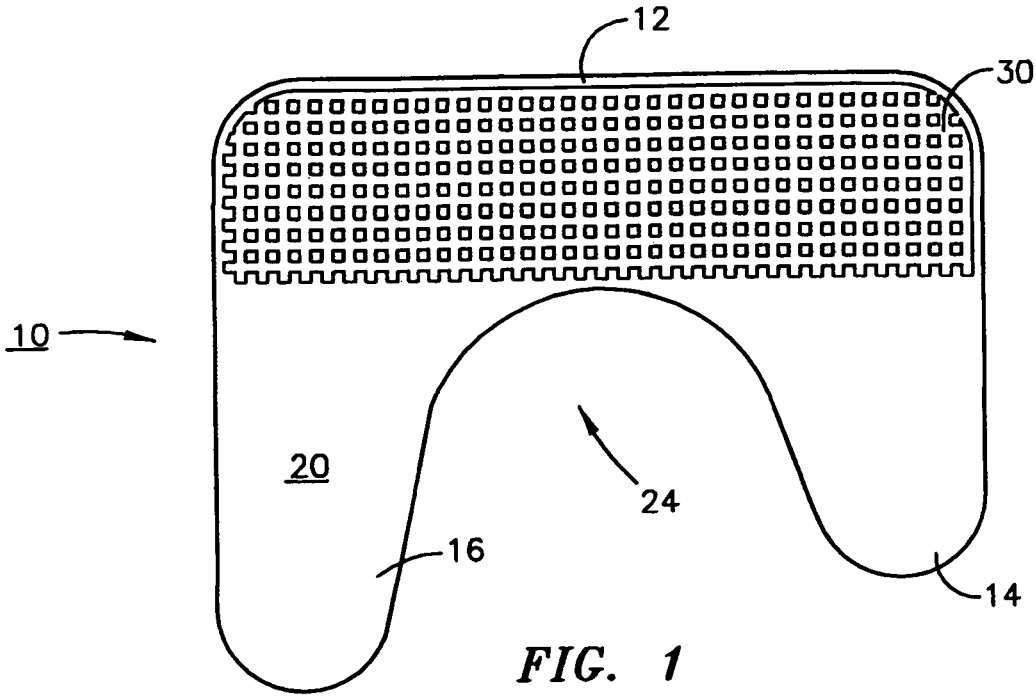
FIG. 1 is bottom plan view of the shoulder protector of the present invention.
Figure 5:
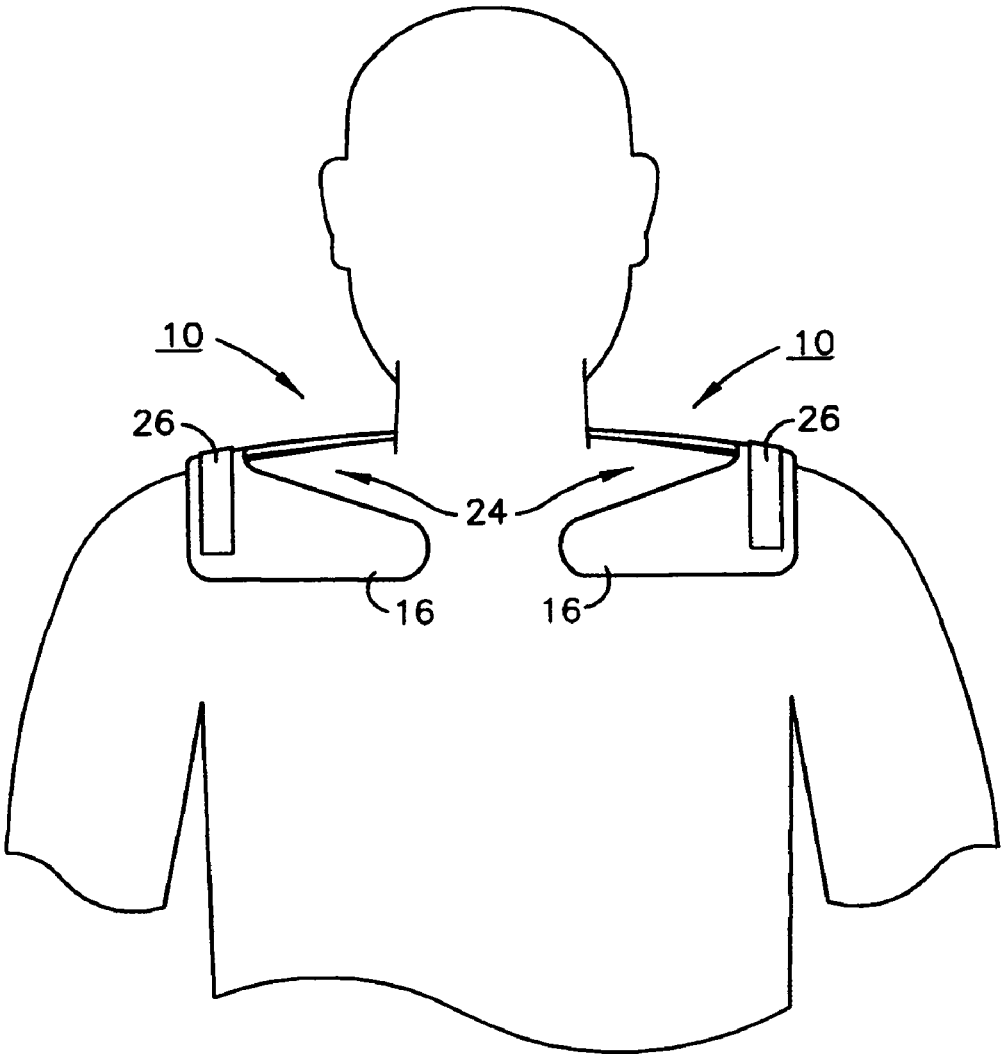
FIG. 5 is a rear view of a user wearing a pair of the shoulder protectors of the present invention.
Figure 6:
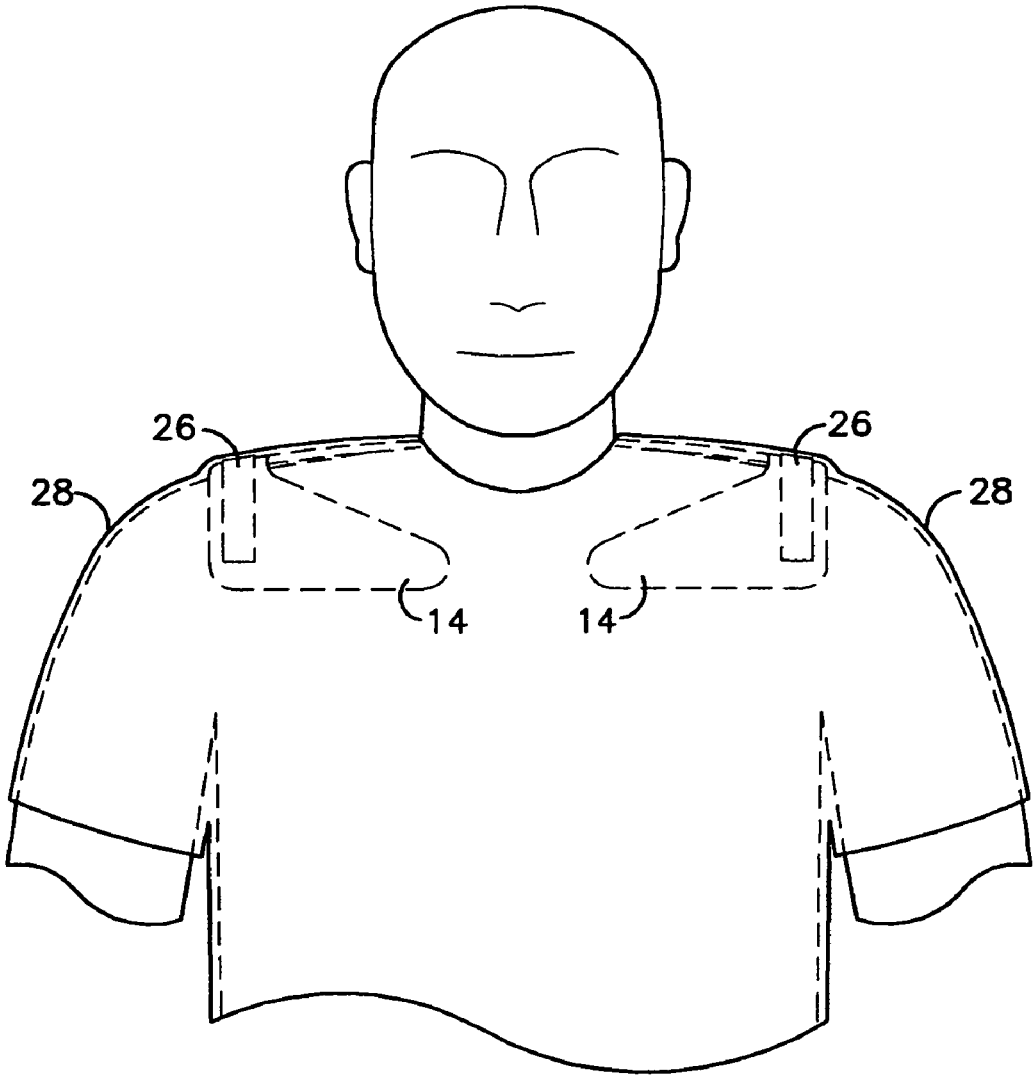
FIG. 6 is a partially phantom front view of a user wearing a pair of the shoulder protectors of the present invention under a jersey.

Referring now to the accompanying drawings, as seen in FIGS. 1 and 6 the shoulder protector of the present invention 10 of the present invention is of a generally "U" shape and comprises a base 12, a front flange 14 extending orthogonally from the base, a rear flange 16 also extending generally orthogonally from base 12, a top surface 18 and a bottom surface 20. Flanges 14 and 16 thus define a channel 24 that fits around the scapula of a user as further described below. The references to "front" and "rear" flanges 14 and 16 respectively are in reference to the location of the relevant flange on the body of a user as will be further depicted and described below and the references to "top" and "bottom" surfaces 18 and 20 are similarly in reference to the location of the relevant surface with respect to the body of the user, all as shown in FIGS. 5 and 6 that show a pair of shoulder protectors 10 applied to the shoulders 22 of a user.

While shoulder protector 10 can be fabricated from a wide variety of resilient, i.e. cushioning materials, closed cell foams and neoprene foams have been found particularly suitable as they provide the required protection of the shoulder area while also being light in weight, a property that is particularly important to, for example, bicyclers. Thus, a single fall device could be constructed of a closed cell polystyrene foam of the proper shape to fit over the shoulder. However, preferred materials are flexible or resilient foams that can assume the shape of any human shoulder, recover their shape after a fall and thus can be reused a multitude of times. Thus, neoprene foams of the type used in diving or surfing protective suits of a thickness of between about 2 and about 9 mm are specifically preferred although virtually any suitable foam that possesses the requisite resiliency could be used.

Figure 2:
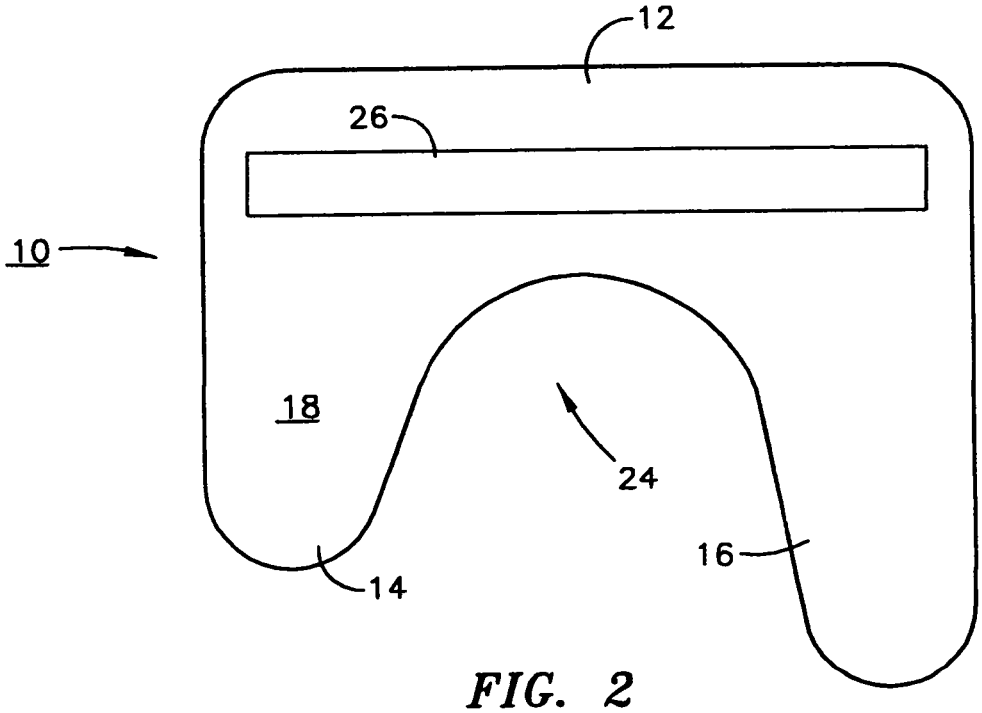
FIG. 2 is a top plan view of the shoulder protector of the present invention.

While the shoulder protector 10 of the present invention is highly useful in the simple configuration just described, a variety of modifications can significantly enhance its utility and comfort. As shown in FIG. 2 that depicts one such modification, top surface 18 of shoulder protector 10 is equipped with at least a strip of the so-called "hook" side of a Velcro® fastener 26. The presence of strip 26 allows shoulder protector 10 to adhere, through the action of strip 26, to an overapplied jersey 28, as shown in FIG. 6. This adhesion helps to maintain the position of shoulder protector 10 in the proper position on the shoulder during even strenuous physical activity.

A second preferred modification is depicted in FIG. 1. As shown in this Figure, bottom side 20 of shoulder protector 10 is equipped with a "hygienic" layer 30 of a material that allows the shoulder area to breathe during exertion and the production of perspiration. Layer 30 may comprise a mesh, as shown in FIG. 1 or a continuous and coextensive or partially extensive layer of a breathable fabric such as Gore-Tex® that allows for the removal of perspiration through evaporation, a layer of a wicking material such as the well known Dryskin® and similar materials that absorb perspiration and remove it from contact with the body. Such a layer provides not only an additional layer of protection but also offers hygienic advantages in removing bacteria that may be present in the perspiration from the body thereby reducing the likelihood of infection in the case of impact during a fall.

Another modification that is depicted in the shoulder protector 10 presented in FIGS. 1 and 2 relates to the relative size of flanges 14 and 16. Although both of flanges 14 and 16 can be of the same size, as will be noted by a careful study of FIGS. 1 and 2, according to the preferred embodiment depicted in these Figures, rear flange 16 is of a larger size than front flange 14. This preferred modification is desirable since in a normal fall where the user tucks, it is the rear of the shoulder area that most usually receives the blunt of the impact and has the greatest exposure. Thus, enlargement of rear flange 16 provides additional protection against abrasion for this area of the users body.

Figure 3:
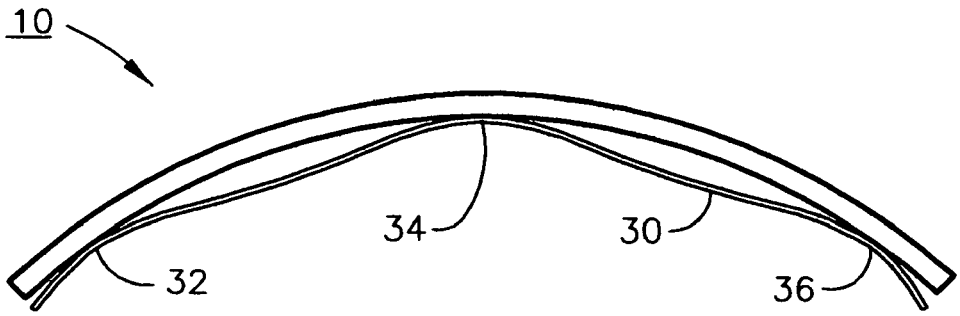
FIG. 3 is a side view of a preferred embodiment of the shoulder protector of the present invention.

Yet another preferred modification of shoulder protector 10 is depicted in FIG. 3. As shown in this Figure hygienic layer 30 is attached at points 32, 34 and 36 so as to cause shoulder protector 10 to arc in a rounded shape more closely adapting to the shape of the shoulder of a user to which it will be applied. The use of this modification further assists in retaining shoulder protector 10 in the proper position on the shoulder of a user during strenuous activity by supplying an appropriate "preshaping" of shoulder protector 10.

As can be readily envisioned by the skilled artisan, it is a relatively simple matter once the structure and design of the shoulder protector of the present invention have been defined to incorporate a pair of shoulder protectors 10 into the structure of an athletic jersey intended for use in one of the sports previously referenced. Such a jersey incorporating a pair of shoulder protectors 10 is clearly contemplated as within the scope of the appended claims.

Although the previously described embodiments of the shoulder protector of the present invention are adequate in their provision of shoulder protection in such lower speed activities as bicycling, higher speed activities such as motorcycling and the like that often result in higher speed and thus, higher impact crashes, may require additional protection particularly for the shoulder and upper arm as opposed to only the clavicle for which the previously described embodiments were designed. Thus, certain modifications of the basic device previously presented are described hereinafter that provide such additional protection.

Figure 4:
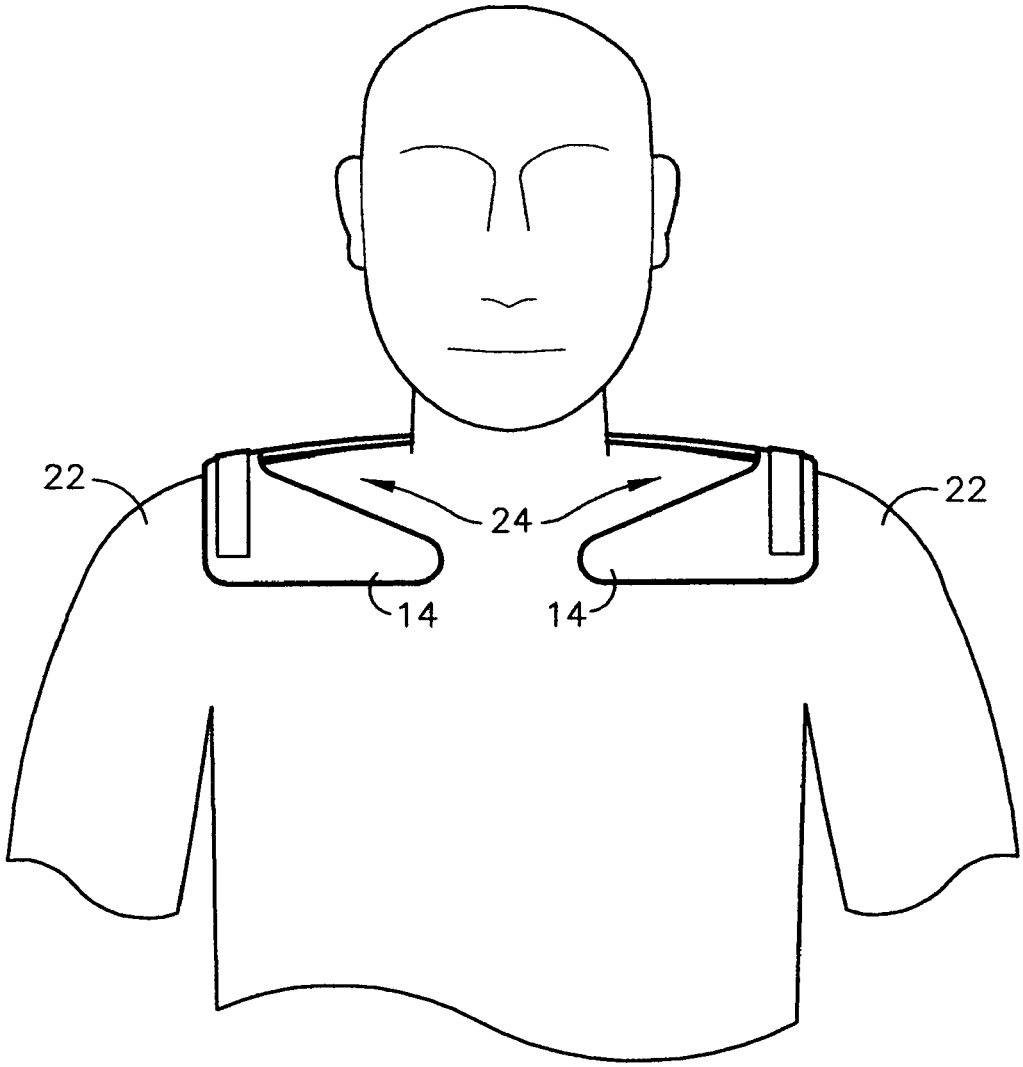
FIG. 4 is a front view of a user wearing a pair of the shoulder protectors of the present invention.
Figure 7:
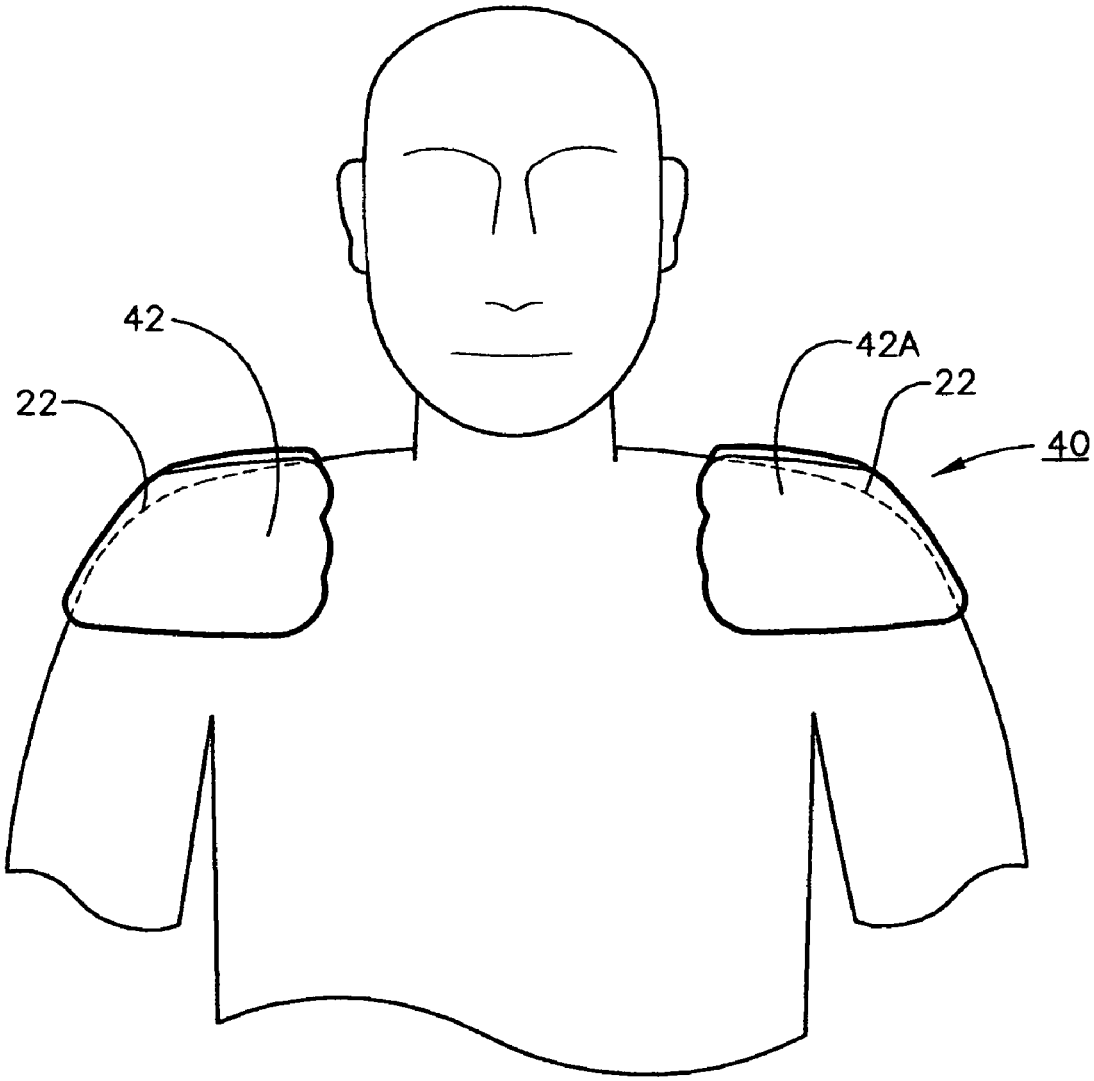
FIG. 7 depicts a front view of an alternative preferred shoulder pad inclusive embodiment of the shoulder protector of the present invention.
Figure 8:
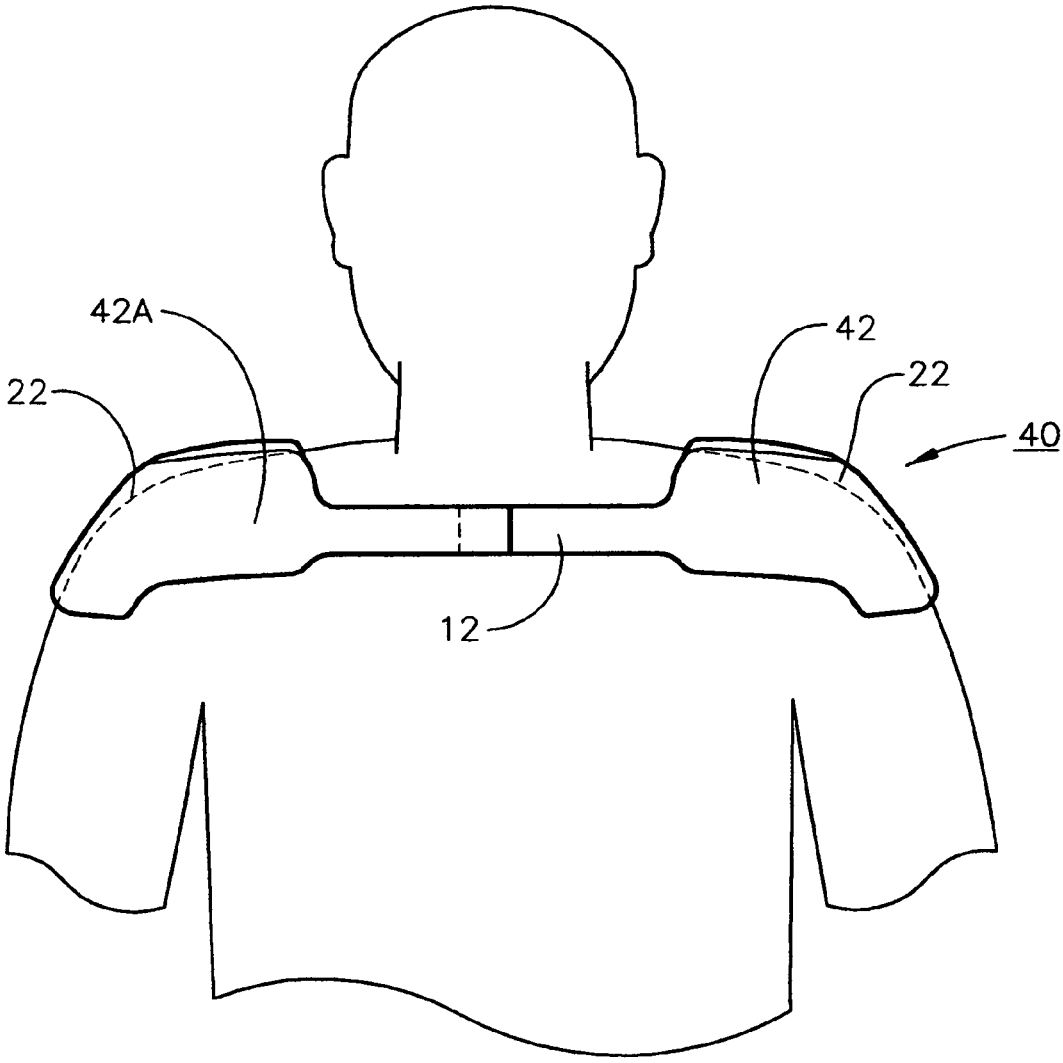
FIG. 8 depicts a rear view of the alternative preferred embodiment of the shoulder protector of the present invention shown in FIG. 7.

Referring now to accompanying FIGS. 7, 8, 9 and 10, according to the alternative preferred embodiment of the shoulder protector of the present invention 40 depicted in these Figures, the shoulder protector depicted specifically in FIGS. 4 and 5 is provided with an opposing pair of shoulder pads 42 and 42A that extend over and below the shoulders 22 of a user. As shown in FIGS. 7 and 8, shoulder pads 42 and 42A extend from opposing extremities of base 12 and are roundedly configured to rest upon and extend beyond and below shoulders 22 of the user. Opposing shoulder pads 42 and 42A are equipped with a number of unique features including, as depicted specifically in FIGS. 9 and 1, lines 44 and 46 that serve to delineate portions of opposing shoulder pads 42 and 42A and along which opposing shoulder pads 42 and 42A can be cut to reduce the size thereof for adaptation to the smaller size of a variety of users. Optionally, lines 44 and 46 may be serrated to allow for more ready and easier removal of unwanted portions of opposing shoulder pads 42 and 42A therealong. Opposing shoulder pads 42 and 42A functionally incorporate front and rear flanges 14 and 16 described hereinabove.

Figure 9:
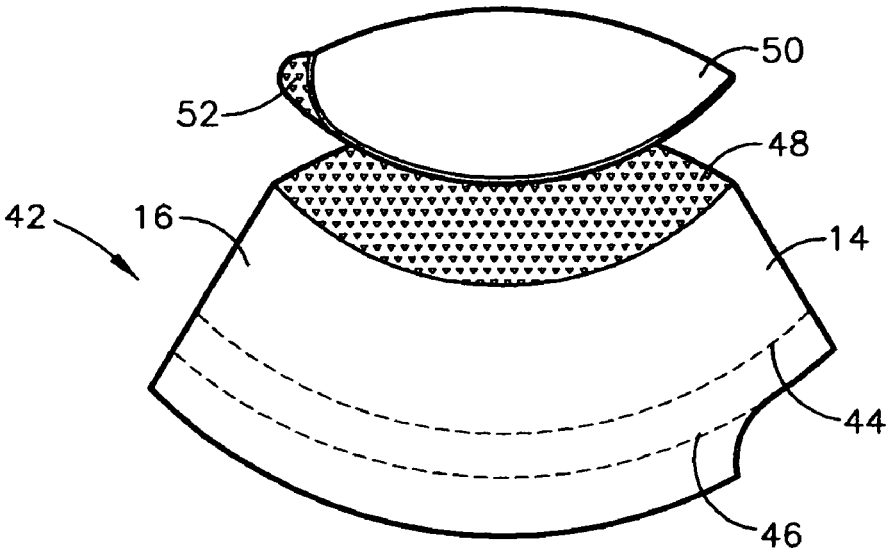
FIG. 9 depicts an exploded perspective view of a portion of the alternative preferred embodiment of the shoulder protector of the present invention shown in FIG. 7 including a removable shoulder pad.
Figure 10:
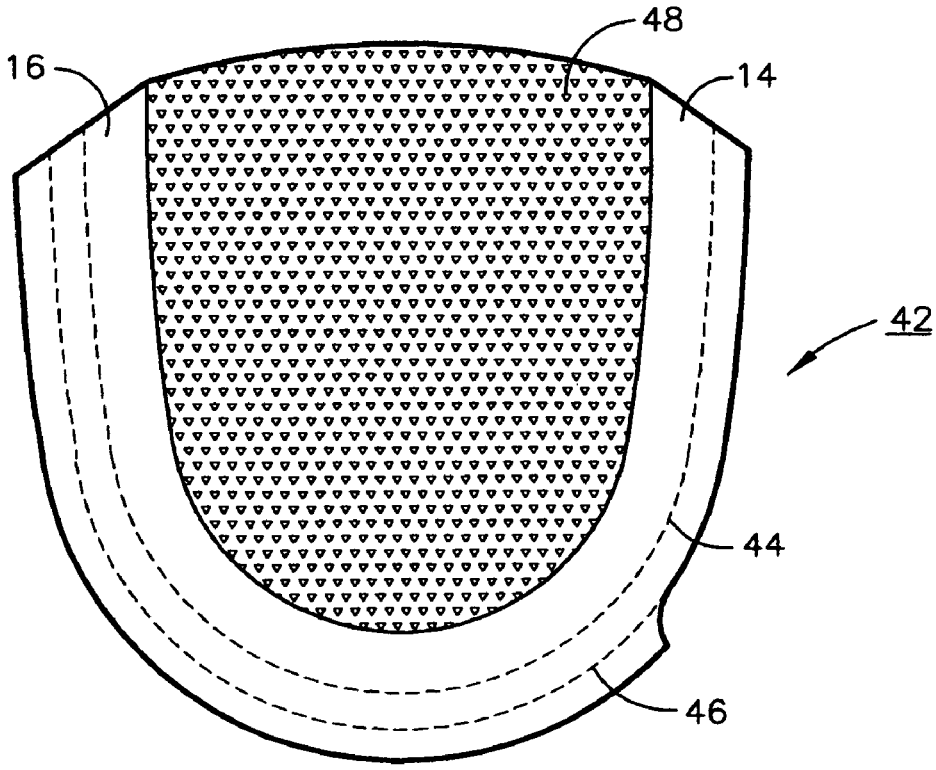
FIG. 10 is a top pan view of the shoulder pad area of the alternative preferred embodiment of the shoulder protector of the present invention shown in FIG. 7.

Another unique feature of opposing shoulder pads 42 and 42A is the provision of a removably adherent material such as Velcro® or similar fastening system 48 for the removable attachment of a rigid plastic or the like additional shoulder protective device 50 having an underside 52 that is equipped with a matching or attaching surface that engages fastening system 48 as best seen in FIG. 9. An additional rigid shoulder protective device or pad 50, such as that depicted in FIG. 9, is highly useful for the protection of, for example, a motorcycle rider who, in a crash, may require more protection than that required/provided by shoulder protector 10 of the present invention when used by a bicycle rider.

There has thus been described a shoulder protector for use by participants in sporting activities where falling is a common hazard. The shoulder protector is light weight, easily applied and does not in any way interfere with movement of the user while providing a degree of protection previously unavailable to such active sports participants.

As the invention has been described, it will be apparent to those skilled in the art that the same may be varied in many ways without departing from the spirit and scope thereof. Any and all such modifications are intended to be included within the scope of the appended claims.

What is claimed is:

1. A generally U-shaped shoulder protector comprising:

a) a base having opposing extremities; and b) a pair of opposing shoulder pads extending one each from the opposing extremities; each of the opposing shoulder pads having a rounded interior for adaptation to the shape of the shoulder; and incorporating a rear flange extending generally orthogonally from the base and a front flange extending generally orthogonally from the base parallel to the rear flange;

the front and rear flanges together defining a channel for reception of the scapula area of the body and the opposing shoulder pads extending beyond and below the shoulders of a user when the shoulder protector is applied to the shoulders of a user.

2. The generally U-shaped shoulder protector of claim 1 that is fabricated from a resilient material.

3. The generally U-shaped shoulder protector of claim 2 fabricated from a closed cell foam or neoprene.

4. The generally U-shaped shoulder protector of claim 1 wherein the opposing shoulder pads each have a top surface and include a layer of removably adherent material on the top surface.

5. The generally U-shaped shoulder protector of claim 2 further comprising a top surface and a bottom surface and a hygienic layer attached to the bottom surface.

6. The generally U-shaped shoulder protector of claim 5 wherein the hygienic layer is selected from the group consisting of mesh materials, breathable fabrics and wicking fabrics.

7. The generally U-shaped shoulder protector of claim 4 further comprising a top surface and a bottom surface and a hygienic layer attached to the bottom surface.

8. The generally U-shaped shoulder protector of claim 7 wherein the hygienic layer is selected from the group consisting of mesh materials, breathable fabrics and wicking fabrics.

9. The generally U-shaped shoulder protector of claim 2 wherein the hygienic layer is attached at multiple points to the bottom surface in such a fashion as to cause the shoulder protector to arch in a rounded shape.

10. The generally U-shaped shoulder protector of claim 4 wherein the hygienic layer is attached at multiple points to the bottom surface in such a fashion as to cause the shoulder protector to arch in a rounded shape.

11. The generally U-shaped shoulder protector of claim 5 wherein the hygienic layer is attached at multiple points to the bottom surface in such a fashion as to cause the shoulder protector to arch in a rounded shape.

12. The generally U-shaped shoulder protector of claim 4 further including a rigid shoulder pad removably attached to the layer of removably adherent material on the top surface.

13. The generally U-shaped shoulder protector of claim 4 wherein the opposing shoulder pads include lines that serve to delineate portions of the opposing shoulder along which the opposing shoulder can be cut to reduce the size thereof for adaptation to a variety of users.

14. The generally U-shaped shoulder protector of claim 13 wherein the lines are serrated to allow for easier removal of unwanted portions of the opposing shoulder pads.

* * * * *